US011584621B2

(12) United States Patent
Bhaskar et al.

(10) Patent No.: US 11,584,621 B2
(45) Date of Patent: Feb. 21, 2023

(54) AUTONOMOUS ELEVATOR CAR MOVERS AND TRACTION SURFACES THEREFOR, CONFIGURED WITH TRACTION INCREASING AND GUIDANCE ENHANCING IMPLEMENTS

(71) Applicant: Otis Elevator Company, Farmington, CT (US)

(72) Inventors: Kiron Bhaskar, Farmington, CT (US); Sam Thieu Wong, Bridgeport, CT (US); Brad Guilani, Woodstock Valley, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 363 days.

(21) Appl. No.: 16/943,049

(22) Filed: Jul. 30, 2020

(65) Prior Publication Data

US 2022/0033226 A1 Feb. 3, 2022

(51) Int. Cl.

| | |
|---|---|
| ***B66B 11/04*** | (2006.01) |
| ***B66B 5/02*** | (2006.01) |
| ***B66B 9/02*** | (2006.01) |

(52) U.S. Cl.

CPC ..... *B66B 11/0407* (2013.01); *B66B 5/02* (2013.01); *B66B 9/02* (2013.01); *B66B 2201/307* (2013.01)

(58) Field of Classification Search

CPC ..... B66B 11/005; B66B 11/0407; B66B 9/02; B66B 2201/307

See application file for complete search history.

(56) References Cited

U.S. PATENT DOCUMENTS

| | | | | |
|---|---|---|---|---|
| 2001/0020429 | A1 | 9/2001 | Serrano | |
| 2019/0077636 | A1 * | 3/2019 | Bhaskar | B66B 9/003 |

FOREIGN PATENT DOCUMENTS

| | | | | |
|---|---|---|---|---|
| DE | 10140390 | A1 * | 3/2003 | B66B 11/0055 |
| EP | 0684204 | A2 * | 11/1995 | |
| EP | 1468950 | A1 * | 10/2004 | B66B 11/0407 |
| EP | 1860051 | A1 * | 11/2007 | B66B 9/02 |
| EP | 3453664 | A1 | 3/2019 | |
| JP | H06211466 | A | 8/1994 | |
| JP | H0840671 | A * | 2/1996 | |

OTHER PUBLICATIONS

Machine Translation of JPH 06-211466.*

European Search Report; dated Dec. 13, 2021; Application No. 21188473.9; Filed: Jul. 29, 2021; 8 pages.

* cited by examiner

*Primary Examiner* — Diem M Tran

(74) *Attorney, Agent, or Firm* — Cantor Colburn LLP

(57) ABSTRACT

Disclosed is a ropeless elevator system having: a car mover operationally connected to an elevator car, the car mover configured to move along a car mover track in a hoistway lane, thereby moving the elevator car along the hoistway lane, wherein the car mover has a first tire of a first wheel that is configured to engage the car mover track when the car mover moves along the car mover track, wherein one or more of the first tire and the car mover track has an engagement feature for increasing traction between the first tire and the car mover track.

13 Claims, 7 Drawing Sheets

AUTONOMOUS ELEVATOR CAR MOVERS AND TRACTION SURFACES THEREFOR, CONFIGURED WITH TRACTION INCREASING AND GUIDANCE ENHANCING IMPLEMENTS

BACKGROUND

Embodiments described herein relate to a multi-car elevator system and more specifically to autonomous elevator car movers and traction surfaces therefor, configured with traction increasing and guidance enhancing implements.

An autonomous elevator car mover may use motor-driven wheels to propel the elevator car up and down on vertical I-beam tracks. Two elements to this system include the elevator car which will be guided by rollers guides on traditional T-rails, and the autonomous car mover which will house two (2) to four (4) motor-driven wheels. A goal of the connection between the car mover wheels and the I-beam track includes maximizing friction between these elements. In addition, to the extent feasible, another goal is to minimize normal forces required between the car mover wheels and the I-beam tracks while maximizing friction between these elements.

BRIEF SUMMARY

Disclosed is a ropeless elevator system including: a car mover operationally connected to an elevator car, the car mover configured to move along a car mover track in a hoistway lane, thereby moving the elevator car along the hoistway lane, wherein the car mover includes a first tire of a first wheel that is configured to engage the car mover track when the car mover moves along the car mover track, wherein one or more of the first tire and the car mover track includes an engagement feature for increasing traction between the first tire and the car mover track.

In addition to one or more of the above disclosed aspects, or as an alternate, the first tire includes the engagement feature, wherein the engagement feature includes a first coil winding configured for being powered to provide one or more of heat and magnetic flux.

In addition to one or more of the above disclosed aspects, or as an alternate, the first coil winding is configured for being powered to provide heat and a second coil winding configured for being powered to provide magnetic flux.

In addition to one or more of the above disclosed aspects, or as an alternate, a controller of the car mover is operationally connected to the first coil winding and configured to direct power to the first coil winding depending on one or more of time, a distance between to the car mover track and the car mover, a temperature of the first tire, and slippage between the first tire and the car mover track.

In addition to one or more of the above disclosed aspects, or as an alternate, a sensor is operationally connected to the car mover and configured to provide sensor data indicative of one or more of the distance between the car mover track and the car mover, the temperature of the first tire, and slippage between the first tire and the car mover track.

In addition to one or more of the above disclosed aspects, or as an alternate, the sensor transmits the sensor data to the controller directly, via a wireless network or via a cloud service, and wherein the sensor data is analyzed in whole or part at one or more of the sensor, the cloud service and the controller.

In addition to one or more of the above disclosed aspects, or as an alternate, the first coil winding receives power from a motor that drives the first wheel, wherein the motor is operationally connected to the controller.

In addition to one or more of the above disclosed aspects, or as an alternate, the first tire engages a first side of the car mover track; and the car mover includes a second tire of a second wheel that engages a second side of the car mover track, wherein the second tire includes a second tire coil winding configured for being powered to provide magnetic flux so that the first tire and the second tire are either attracted toward or repelled away from each other.

In addition to one or more of the above disclosed aspects, or as an alternate, the car mover track includes a track engagement feature that is configured to enhance one or more of traction and guidance when engaged by the first tire.

In addition to one or more of the above disclosed aspects, or as an alternate, the track engagement feature is one or more of: a track cross section of the car mover track that forms a diamond profile or a circular profile; and a track web cross section of the car mover track that forms a convex profile, a concave profile, or a semi-circular profile on one side or both sides of the of the car mover track.

In addition to one or more of the above disclosed aspects, or as an alternate, the first tire includes a tire engagement feature and the car mover track includes a track engagement feature, wherein the tire engagement feature and the track engagement feature are located and shaped to complement each other and engage each other when the car mover moves along the car mover track.

In addition to one or more of the above disclosed aspects, or as an alternate, the tire engagement feature is one of protrusions and impressions formed circumferentially along an outer annular surface of the first tire; and the track engagement feature is another of protrusions and impressions along the car mover track.

In addition to one or more of the above disclosed aspects, or as an alternate, the tire engagement feature is axially centered or offset from an axial center of the first tire; or the tire engagement feature and the track engagement feature form a triangular waveform profile.

In addition to one or more of the above disclosed aspects, or as an alternate, the car mover track includes the engagement feature, wherein the engagement feature is one or more of: a surface coating; a surface finish; a surface contour that centers the first tire on the car mover track when the car mover moves along the car mover track, and complimentary alignment features between track sections.

Further disclosed is a method of operating a ropeless elevator system including: powering a first coil winding in a first tire of a first wheel of a car mover operationally connected to an elevator car, wherein the car mover configured to move along a car mover track in a hoistway lane, thereby moving the elevator car along the hoistway lane; and providing one or more of heat and magnetic flux from powering the first coil winding.

In addition to one or more of the above disclosed aspects, or as an alternate, the method includes a controller of the car mover, operationally connected to the first coil winding, directing power the first coil winding depending on one or more of time, a distance between to the car mover track and the car mover, a temperature of the first tire, and slippage between the first tire and the car mover track.

In addition to one or more of the above disclosed aspects, or as an alternate, the method includes a sensor, operationally connected to the car mover, providing sensor data indicative of one or more of the distance between the car mover track and the car mover, a temperature of the first tire, and slippage between the first tire and the car mover track.

In addition to one or more of the above disclosed aspects, or as an alternate, the method includes the sensor transmitting the sensor data to the controller, directly, via a wireless network or via a cloud service, wherein the sensor data is analyzed in whole or part at one or more of the sensor, the cloud service and the controller.

In addition to one or more of the above disclosed aspects, or as an alternate, the method includes the first coil winding receiving power from a motor that drives the first wheel, wherein the motor is operationally connected to the controller.

In addition to one or more of the above disclosed aspects, or as an alternate, the method includes the first tire engaging a first side of the car mover track; and powering a second tire coil winding in a second tire of a second wheel of the car mover, the second tire engaging a second side of the car mover track, to provide magnetic flux so that the first tire and the second tire are selectively attracted toward and repelled away from each other.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

Figure 1:
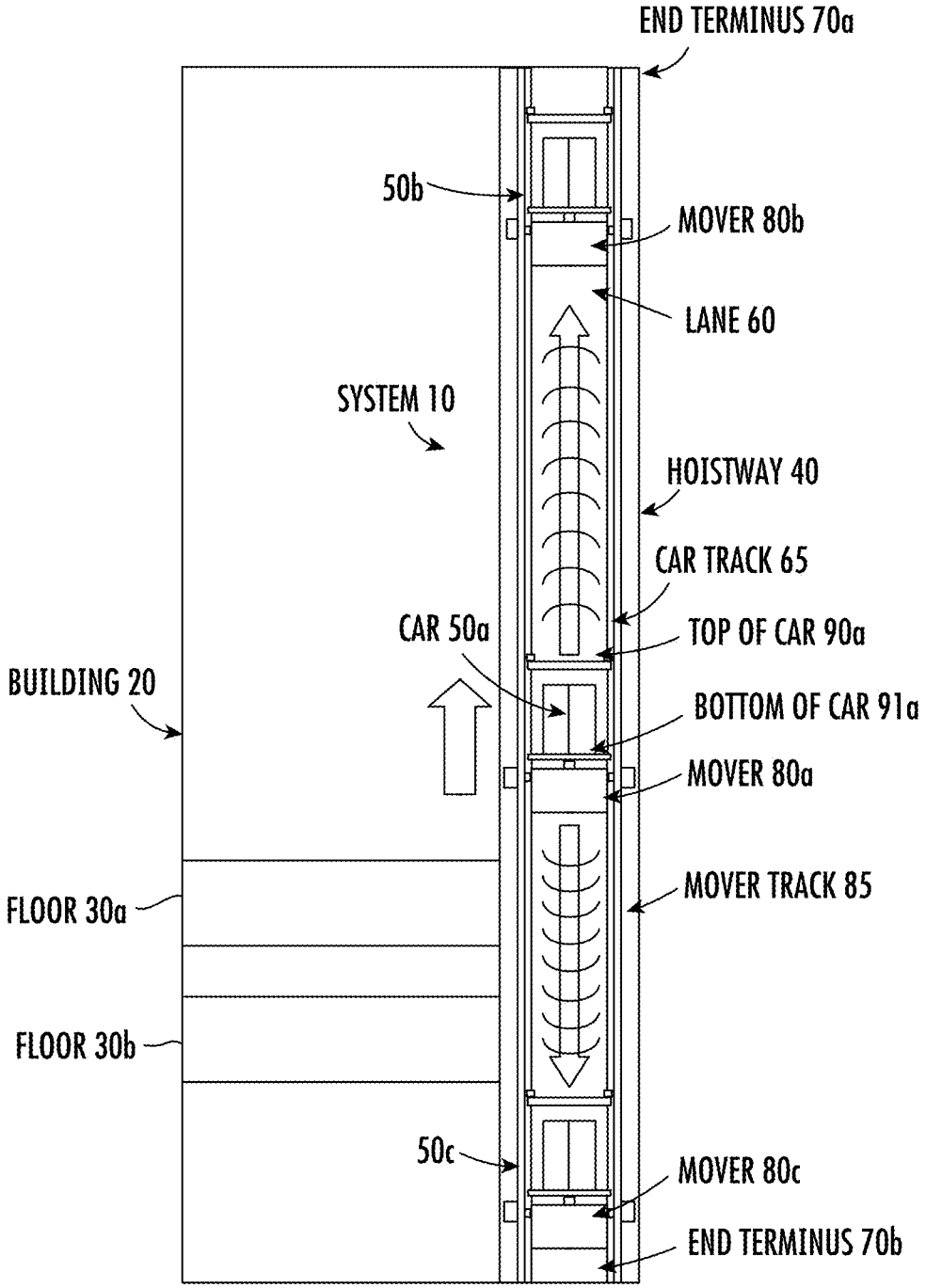
FIG. 1 is a schematic of elevator cars and car movers in a hoistway lane according to an embodiment.

FIG. 1 depicts a self-propelled or ropeless elevator system (elevator system) 10 in an exemplary embodiment that may be used in a structure or building 20 having multiple levels or floors 30*a*, 30*b*. Elevator system 10 includes a hoistway 40 (or elevator shaft) defined by boundaries carried by the building 20, and a plurality of cars 50*a*-50*c* adapted to travel in a hoistway lane 60 along an elevator car track 65 (which may be a T-rail) in any number of travel directions (e.g., up and down). The cars 50*a*-50*c* are generally the same so that reference herein shall be to the elevator car 50*a*. The hoistway 40 may also include a top end terminus 70*a* and a bottom end terminus 70*b*.

For each of the cars 50*a*-50*c*, the elevator system 10 includes one of a plurality of car mover systems (car movers) 80*a*-80*c* (otherwise referred to as a beam climber system, or beam climber, for reasons explained below). The car movers 80*a*-80*c* are generally the same so that reference herein shall be to the car 50*a*. The car mover 80*a* is configured to move along a car mover track 85 (which may be an I-beam) to move the elevator car 50*a* along the hoistway lane 60, and to operate autonomously. The car mover 80*a* may positioned to engage the top 90*a* of the car 50*a*, the bottom 91*a* of the car 50*a* or both. In FIG. 1, the car mover 80*a* engages the bottom 91*a* of the car 50*a*.

Figure 2:
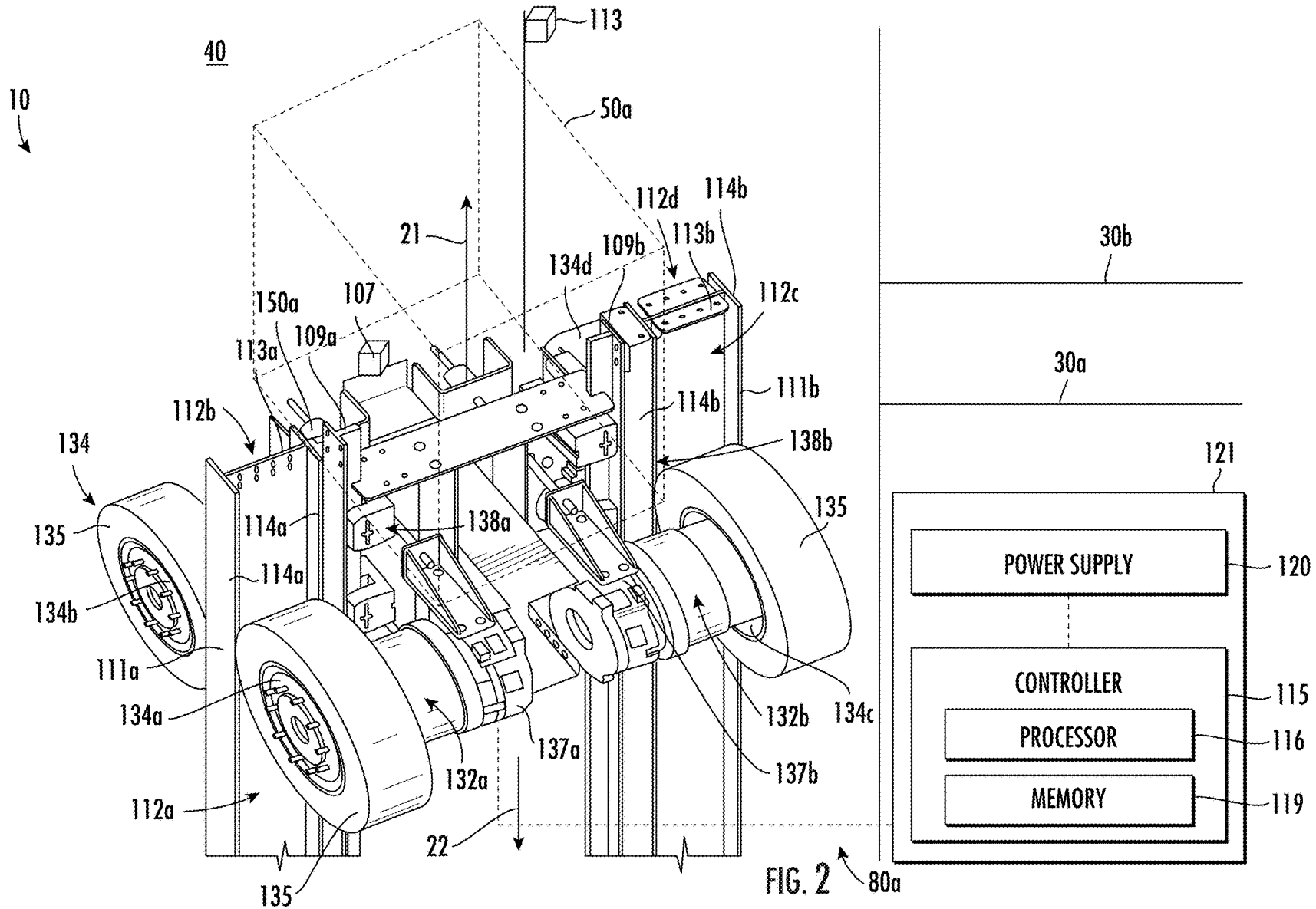
FIG. 2 shows a car mover according to an embodiment.

FIG. 2 is a perspective view of an elevator system 10 including the elevator car 50*a*, a car mover 80*a*, a controller 115, and a power source 120. Although illustrated in FIG. 1 as separate from the car mover 80*a*, the embodiments described herein may be applicable to a controller 115 included in the car mover 80*a* (i.e., moving through an hoistway 40 with the car mover 80*a*) and may also be applicable a controller located off of the car mover 80*a* (i.e., remotely connected to the car mover 80*a* and stationary relative to the car mover 80*a*).

Although illustrated in FIG. 1 as separate from the car mover 80*a*, the embodiments described herein may be applicable to a power source 120 included in the car mover 80*a* (i.e., moving through the hoistway 40 with the car mover 80*a*) and may also be applicable to a power source located off of the car mover 80*a* (i.e., remotely connected to the car mover 80*a* and stationary relative to the car mover 80*a*).

The car mover 80*a* is configured to move the elevator car 50*a* within the hoistway 40 and along guide rails 109*a*, 109*b* that extend vertically through the hoistway 40. In an embodiment, the guide rails 109*a*, 109*b* are T-beams. The car mover 80*a* includes one or more electric motors 132*a*, 132*b*. The electric motors 132*a*, 132*b* are configured to move the car mover 80*a* within the hoistway 40 by rotating one or more motorized wheels 134*a*, 134*b* that are pressed against a guide beam 111*a*, 111*b* that form the car mover track 85 (FIG. 1). In an embodiment, the guide beams 111*a*, 111*b* are I-beams. It is understood that while an I-beam is illustrated any beam or similar structure may be utilized with the embodiment described herein. Friction between the wheels 134*a*, 134*b*, 134*c*, 134*d* driven by the electric motors 132*a*, 132*b* allows the wheels 134*a*, 134*b*, 134*c*, 134*d* climb up 21 and down 22 the guide beams 111*a*, 111*b*. The guide beam extends vertically through the hoistway 40. It is understood that while two guide beams 111*a*, 111*b* are illustrated, the embodiments disclosed herein may be utilized with one or more guide beams. It is also understood that while two electric motors 132*a*, 132*b* are illustrated, the embodiments disclosed herein may be applicable to car movers 80*a* having one or more electric motors. For example, the car mover 80*a* may have one electric motor for each of the four wheels 134*a*, 134*b*, 134*c*, 134*d* (generically wheels 134). The electrical motors 132*a*, 132*b* may be permanent magnet electrical motors, asynchronous motor, or any electrical motor known to one of skill in the art. In other embodiments, not illustrated herein, another configuration could have the powered wheels at two different vertical locations (i.e., at bottom and top of an elevator car 50*a*).

The first guide beam 111*a* includes a web portion 113*a* and two flange portions 114*a*. The web portion 113*a* of the first guide beam 111*a* includes a first surface 112*a* and a second surface 112*b* opposite the first surface 112*a*. A first wheel 134*a* is in contact with the first surface 112*a* and a second wheel 134*b* is in contact with the second surface 112*b*. The first wheel 134*a* may be in contact with the first surface 112*a* through a tire 135 and the second wheel 134*b* may be in contact with the second surface 112*b* through a tire 135. The first wheel 134*a* is compressed against the first surface 112*a* of the first guide beam 111*a* by a first compression mechanism 150*a* and the second wheel 134*b* is compressed against the second surface 112*b* of the first guide beam 111*a* by the first compression mechanism 150*a*. The first compression mechanism 150*a* compresses the first wheel 134*a* and the second wheel 134*b* together to clamp onto the web portion 113*a* of the first guide beam 111*a*.

The first compression mechanism 150*a* may be a metallic or elastomeric spring mechanism, a pneumatic mechanism, a hydraulic mechanism, a turnbuckle mechanism, an electromechanical actuator mechanism, a spring system, a hydraulic cylinder, a motorized spring setup, or any other known force actuation method.

The first compression mechanism 150*a* may be adjustable in real-time during operation of the elevator system 10 to control compression of the first wheel 134*a* and the second wheel 134*b* on the first guide beam 111*a*. The first wheel 134*a* and the second wheel 134*b* may each include a tire 135 to increase traction with the first guide beam 111*a*.

The first surface 112*a* and the second surface 112*b* extend vertically through the hoistway 40, thus creating a track for the first wheel 134*a* and the second wheel 134*b* to ride on. The flange portions 114*a* may work as guardrails to help guide the wheels 134*a*, 134*b* along this track and thus help prevent the wheels 134*a*, 134*b* from running off track.

The first electric motor 132*a* is configured to rotate the first wheel 134*a* to climb up 21 or down 22 the first guide beam 111*a*. The first electric motor 132*a* may also include a first motor brake 137*a* to slow and stop rotation of the first electric motor 132*a*.

The first motor brake 137*a* may be mechanically connected to the first electric motor 132*a*. The first motor brake 137*a* may be a clutch system, a disc brake system, a drum brake system, a brake on a rotor of the first electric motor 132*a*, an electronic braking, an Eddy current brakes, a Magnetorheological fluid brake or any other known braking system. The beam climber system 130 may also include a first guide rail brake 138*a* operably connected to the first guide rail 109*a*. The first guide rail brake 138*a* is configured to slow movement of the beam climber system 130 by clamping onto the first guide rail 109*a*. The first guide rail brake 138*a* may be a caliper brake acting on the first guide rail 109*a* on the beam climber system 130, or caliper brakes acting on the first guide rail 109 proximate the elevator car 50*a*.

The second guide beam 111*b* includes a web portion 113*b* and two flange portions 114*b*. The web portion 113*b* of the second guide beam 111*b* includes a first surface 112*c* and a second surface 112*d* opposite the first surface 112*c*. A third wheel 134*c* is in contact with the first surface 112*c* and a fourth wheel 134*d* is in contact with the second surface 112*d*. The third wheel 134*c* may be in contact with the first surface 112*c* through a tire 135 and the fourth wheel 134*d* may be in contact with the second surface 112*d* through a tire 135. A third wheel 134*c* is compressed against the first surface 112*c* of the second guide beam 111*b* by a second compression mechanism 150*b* and a fourth wheel 134*d* is compressed against the second surface 112*d* of the second guide beam 111*b* by the second compression mechanism 150*b*. The second compression mechanism 150*b* compresses the third wheel 134*c* and the fourth wheel 134*d* together to clamp onto the web portion 113*b* of the second guide beam 111*b*.

The second compression mechanism 150*b* may be a spring mechanism, turnbuckle mechanism, an actuator mechanism, a spring system, a hydraulic cylinder, and/or a motorized spring setup. The second compression mechanism 150*b* may be adjustable in real-time during operation of the elevator system 10 to control compression of the third wheel 134*c* and the fourth wheel 134*d* on the second guide beam 111*b*. The third wheel 134*c* and the fourth wheel 134*d* may each include a tire 135 to increase traction with the second guide beam 111*b*.

The first surface 112*c* and the second surface 112*d* extend vertically through the shaft 117, thus creating a track for the third wheel 134*c* and the fourth wheel 134*d* to ride on. The flange portions 114*b* may work as guardrails to help guide the wheels 134*c*, 134*d* along this track and thus help prevent the wheels 134*c*, 134*d* from running off track.

The second electric motor 132*b* is configured to rotate the third wheel 134*c* to climb up 21 or down 22 the second guide beam 111*b*. The second electric motor 132*b* may also include a second motor brake 137*b* to slow and stop rotation of the second motor 132*b*. The second motor brake 137*b* may be mechanically connected to the second motor 132*b*. The second motor brake 137*b* may be a clutch system, a disc brake system, drum brake system, a brake on a rotor of the second electric motor 132*b*, an electronic braking, an Eddy current brake, a Magnetorheological fluid brake, or any other known braking system. The beam climber system 130 includes a second guide rail brake 138*b* operably connected to the second guide rail 109*b*. The second guide rail brake 138*b* is configured to slow movement of the beam climber system 130 by clamping onto the second guide rail 109*b*. The second guide rail brake 138*b* may be a caliper brake acting on the first guide rail 109*a* on the beam climber system 130, or caliper brakes acting on the first guide rail 109*a* proximate the elevator car 50*a*.

The elevator system 10 may also include a position reference system 113. The position reference system 113 may be mounted on a fixed part at the top of the hoistway 40, such as on a support or guide rail 109, and may be configured to provide position signals related to a position of the elevator car 50*a* within the hoistway 40. In other embodiments, the position reference system 113 may be directly mounted to a moving component of the elevator system (e.g., the elevator car 50*a* or the car mover 80*a*), or may be located in other positions and/or configurations.

The position reference system 113 can be any device or mechanism for monitoring a position of an elevator car within the elevator shaft 117. For example, without limitation, the position reference system 113 can be an encoder, sensor, accelerometer, altimeter, pressure sensor, range finder, or other system and can include velocity sensing, absolute position sensing, etc., as will be appreciated by those of skill in the art.

The controller 115 may be an electronic controller including a processor 116 and an associated memory 119 comprising computer-executable instructions that, when executed by the processor 116, cause the processor 116 to perform various operations. The processor 116 may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory 119 may be but is not limited to a random access memory (RAM), read only memory (ROM), or other electronic, optical, magnetic or any other computer readable medium.

The controller 115 is configured to control the operation of the elevator car 50*a* and the car mover 80*a*. For example, the controller 115 may provide drive signals to the car mover 80*a* to control the acceleration, deceleration, leveling, stopping, etc. of the elevator car 50*a*.

The controller 115 may also be configured to receive position signals from the position reference system 113 or any other desired position reference device.

When moving up 21 or down 22 within the hoistway 40 along the guide rails 109*a*, 109*b*, the elevator car 50*a* may stop at one or more floors 30*a*, 30*b* as controlled by the controller 115. In one embodiment, the controller 115 may be located remotely or in the cloud. In another embodiment, the controller 115 may be located on the car mover 80*a*

The power supply 120 for the elevator system 10 may be any power source, including a power grid and/or battery power which, in combination with other components, is supplied to the car mover 80*a*. In one embodiment, power source 120 may be located on the car mover 80*a*. In an embodiment, the power supply 120 is a battery that is included in the car mover 80*a*. The elevator system 10 may also include an accelerometer 107 attached to the elevator car 50*a* or the car mover 80*a*. The accelerometer 107 is configured to detect an acceleration and/or a speed of the elevator car 50*a* and the car mover 80*a*.

Figure 3:
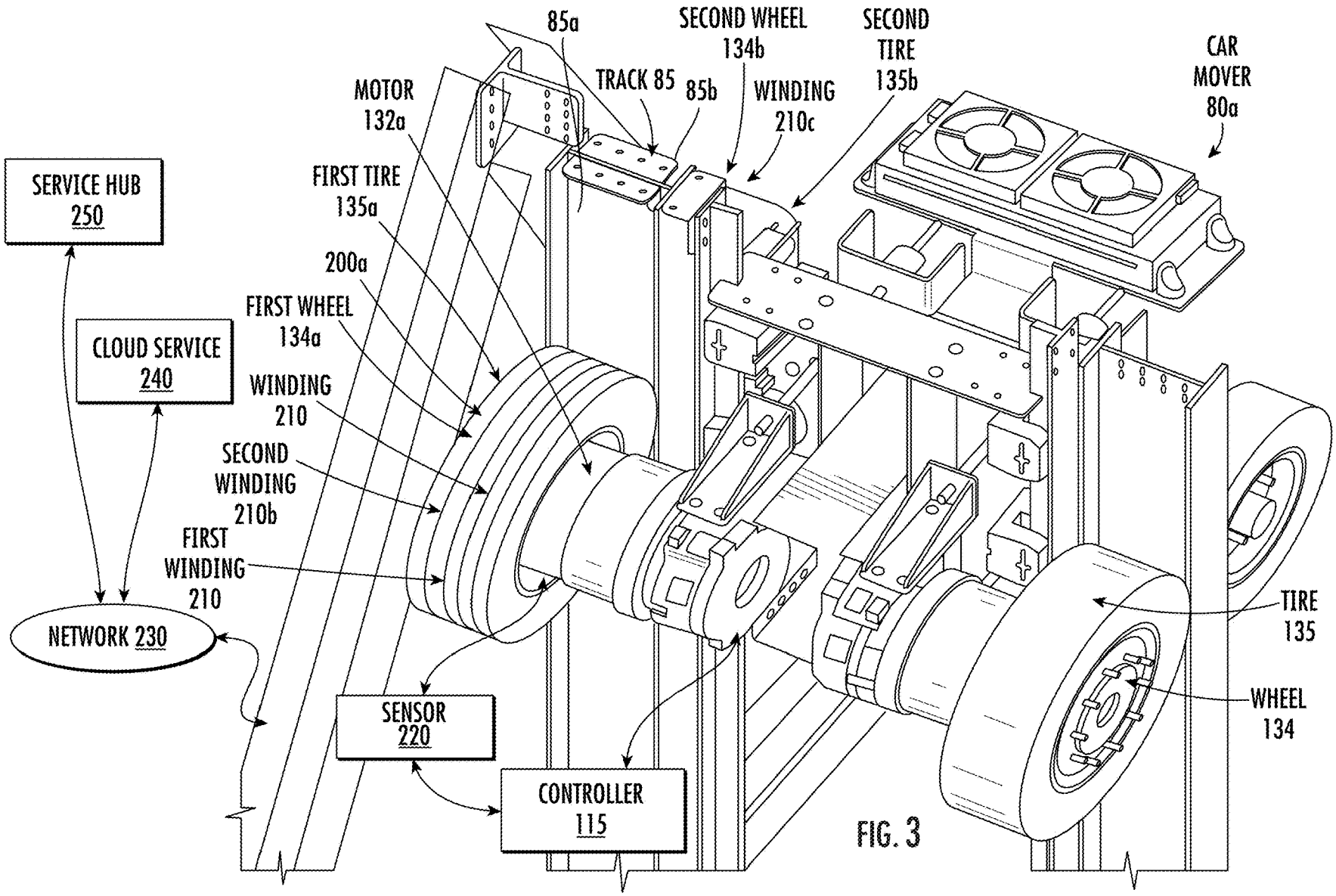
FIG. 3 shows a car mover where wheels are equipped with engagement features in the form of coil windings to provide heat and electromagnetic properties.

Turning now to FIG. 3, an embodiment is disclosed in which one or more of the tires 135 of a respective one or more of the wheels 134 of the car mover 80*a* may include tire engagement features (or tire engagement feature) 200*a* as traction increasing implements. The tire engagement features 200*a* may be in the form of coil windings 210 configured receive power and provide an electromagnet. For simplicity, the one or more of the tires 135 and respective wheels 134 will be referred to as the first tire 135*a* and the first wheel 134*a*, and the coil windings 210 for first tire 135*a* will be referred to as a first coil winding 210*a*.

When using solid rubber tires (though using traditional automobile type rubber tires is within the scope of the disclosure) for the first tire 135*a*, the tire traction may depend on clamping force, surface area, rubber compound, and tread pattern against the car mover track 85 (e.g., an I-beam). The car mover track 85 may be formed from a ferrous material. Decreasing temperatures may lower coefficient of friction between the first tire 135*a* and the car mover track 85, resulting in a loss of traction. Moisture and oils on the first tire 135*a* and on the contact surface of the car mover track 85 (e.g., the web 113 of the I-beam) may also result in a loss of traction.

Thus, as indicated, the first tire 135*a* may incorporate the first coil winding 210*a*, e.g., embedded in the rubber compound that forms the first tire 135*a*. The first coil winding 210*a* may both heat the first tire 135*a* and optionally generate a magnetic field. In one embodiment, the first coil winding 210*a* may be used for heating and a second coil winding 210*b* may be utilized for generating a magnetic field. As the first and second coil windings 210*a*, 210*b* may be the same, for simplicity, reference herein shall be to the first coil winding 210*a*. The magnetic field may be generated throughout a run cycle of a car mover 80*a*, e.g., provided through the motor 132*a* for the first wheel 134*a*. In one embodiment, any number of coil windings may be used.

Powering the first coil winding 210*a* may be controlled by the car mover controller 115 and may be dependent on one or more of time, ambient temperature, tire temperature, slippage of the first tire 135*a* against the car mover track 85, and distance from the car mover track. For example, a difference in relative rotational speed between the first wheel 134*a* and, e.g., a second wheel 134*b* of the car mover 80*a* could indicate slippage. Alternatively, a decrease in torque sensed on the first wheel 134*a* may result from dynamic slippage. Information on one or more of these variables may be obtained from sensor data produced by a sensor 220 that may be operationally connected to the first coil winding 210*a*. The sensor data may be transmitted from the sensor 220 to the car mover controller 115 via one or more transmission channels, including direct (wired connection), a wireless network 230 and via a cloud service 240 (such connections are discussed below). Processing of sensor data, to control powering of the first coil winding 210*a*, may occur in whole or part on the sensor 220 (e.g. via edge processing), the car mover controller 115 or the cloud service 240.

Wireless connections may apply protocols that include local area network (LAN, or WLAN for wireless LAN) protocols and/or a private area network (PAN) protocols. LAN protocols include WiFi technology, based on the Section 802.11 standards from the Institute of Electrical and Electronics Engineers (IEEE). PAN protocols include, for example, Bluetooth Low Energy (BTLE), which is a wireless technology standard designed and marketed by the Bluetooth Special Interest Group (SIG) for exchanging data over short distances using short-wavelength radio waves. PAN protocols also include Zigbee, a technology based on Section 802.15.4 protocols from the IEEE, representing a suite of high-level communication protocols used to create personal area networks with small, low-power digital radios for low-power low-bandwidth needs. Such protocols also include Z-Wave, which is a wireless communications protocol supported by the Z-Wave Alliance that uses a mesh network, applying low-energy radio waves to communicate between devices such as appliances, allowing for wireless control of the same.

Other applicable protocols include Low Power WAN (LPWAN), which is a wireless wide area network (WAN)

designed to allow long-range communications at a low bit rates, to enable end devices to operate for extended periods of time (years) using battery power. Long Range WAN (LoRaWAN) is one type of LPWAN maintained by the LoRa Alliance, and is a media access control (MAC) layer protocol for transferring management and application messages between a network server and application server, respectively. Such wireless connections may also include radio-frequency identification (RFID) technology, used for communicating with an integrated chip (IC), e.g., on an RFID smartcard. In addition, Sub-1 Ghz RF equipment operates in the ISM (industrial, scientific and medical) spectrum bands below Sub 1 Ghz—typically in the 769-935 MHz, 315 Mhz and the 468 Mhz frequency range. This spectrum band below 1 Ghz is particularly useful for RF IOT (internet of things) applications. Other LPWAN-IOT technologies include narrowband internet of things (NB-IOT) and Category M1 internet of things (Cat M1-IOT). Wireless communications for the disclosed systems may include cellular, e.g. 2G/3G/4G (etc.). The above is not intended on limiting the scope of applicable wireless technologies.

Wired connections may include connections (cables/interfaces) under RS (recommended standard)-422, also known as the TIA/EIA-422, which is a technical standard supported by the Telecommunications Industry Association (TIA) and which originated by the Electronic Industries Alliance (EIA) that specifies electrical characteristics of a digital signaling circuit. Wired connections may also include (cables/interfaces) under the RS-232 standard for serial communication transmission of data, which formally defines signals connecting between a DTE (data terminal equipment) such as a computer terminal, and a DCE (data circuit-terminating equipment or data communication equipment), such as a modem. Wired connections may also include connections (cables/interfaces) under the Modbus serial communications protocol, managed by the Modbus Organization. Modbus is a master/slave protocol designed for use with its programmable logic controllers (PLCs) and which is a commonly available means of connecting industrial electronic devices. Wireless connections may also include connectors (cables/interfaces) under the PROFibus (Process Field Bus) standard managed by PROFIBUS & PROFINET International (PI). PROFibus which is a standard for fieldbus communication in automation technology, openly published as part of IEC (International Electrotechnical Commission) 61158. Wired communications may also be over a Controller Area Network (CAN) bus. A CAN is a vehicle bus standard that allow microcontrollers and devices to communicate with each other in applications without a host computer. CAN is a message-based protocol released by the International Organization for Standards (ISO). The above is not intended on limiting the scope of applicable wired technologies.

In one embodiment, second tire coil winding 210*b* is disposed on the second tire 135*b* of the second wheel 134*b*, which rides on an opposing side of the car mover track 85 from the first tire 135*a*. Magnetic polarity of the electromagnets may be configured to draw the first and second tires 135*a*, 135*b* toward each other to increase traction. In addition, if the sensor 220 senses that the first tire 135*a* is dragging, e.g. due to a debris, the polarity of the first coil winding 210*a* in it may be momentarily reversed to enable the first and second tires 135*a*, 135*b* to quickly move away from the car mover track 85 and dislodge the debris. If this action does not succeed, a maintenance alert may be created by the controller 115 and transmitted to a service hub 250 for the elevator system 10.

With the disclosed embodiments, the first tire 135*a* is warmed by the first coil winding 210*a* to provide a greater amount of traction. An electromagnetic force is also added by the first coil winding 210*a* to provide traction and thereby decrease a required amount of clamping force and a surface area required to generate normal forces and suspend the car mover 80*a*. Ferrous material that may be attracted by the first coil winding 210*a* may be released when the first coil winding 210*a* is turned off.

Figure 4:
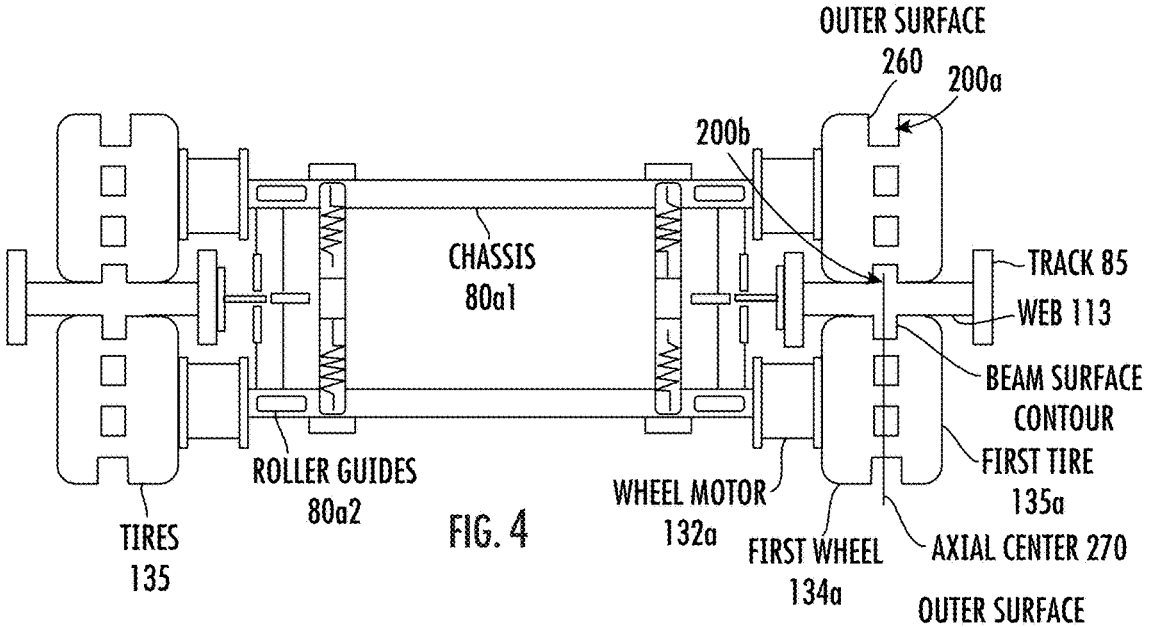
FIG. 4 shows portions of a car mover, where wheels and a web of the car mover track have engagement features in the form of complimentary impressions in the wheels and protrusions in the web, to provide enhanced traction.
Figure 5:
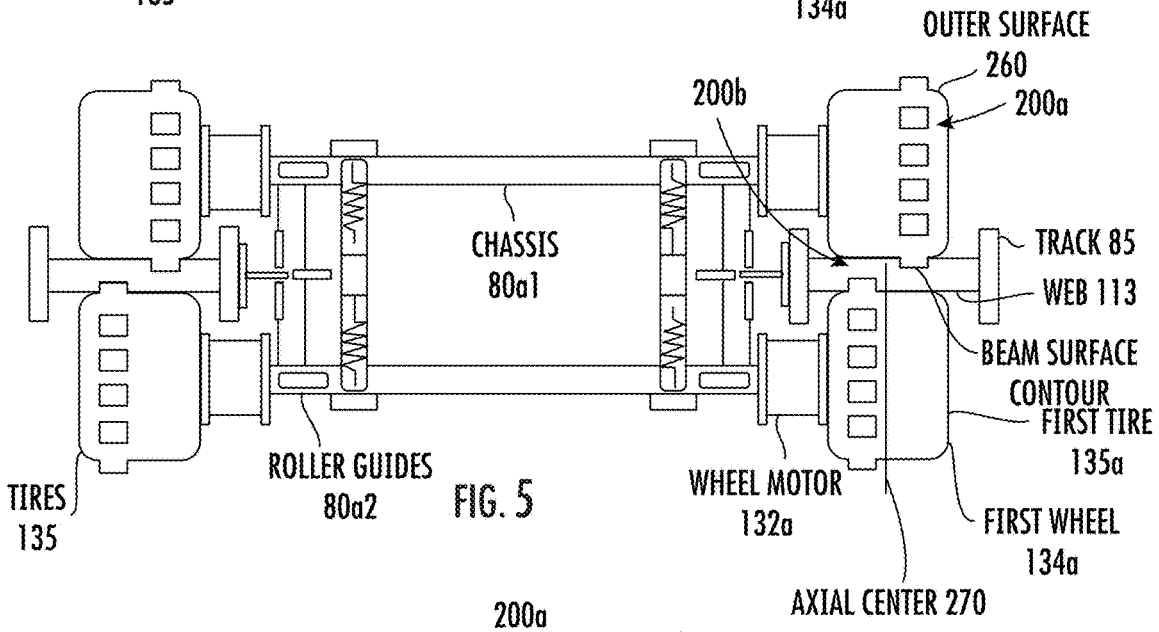
FIG. 5 shows portions of a car mover, where wheels and a web of the car mover track have engagement features in the form of complimentary impressions in the web and protrusions in the wheels, to provide enhanced traction.

Turning to FIGS. 4-6, an embodiment is shown where the tires 135 have a tire engagement features 200*a* and the web 113 of the car mover track 85 (shown as an I-beam) has a track engagement feature 200. In FIGS. 4-6, for reference, the chassis 80*a*1 and roller guides 80*a*2 of the car mover 80*a* are shown and labeled. The tire and track engagement features 200*a*, 200*b* (which may be referred to as engagement features 200*a*, 200*b*) are the form of matching surface profiles that provide for increased traction along the travelling path. For simplicity the first tire 135*a* and the first wheel 134*a* will again be the focus of this discussion as the tires 135 and wheels 134 have the same features. In some embodiments (e.g., as shown in FIG. 3), the first tire 135*a* is a traction tire that travels on a flat steel beam surface formed by the web 113 of the car mover track 85. The features shown in FIGS. 4-6 address challenges of maintaining traction between the first tire 135*a* and the car mover track 85 while potentially reducing a required normal force.

More specifically, as illustrated in FIG. 4 the engagement features 200*a*, 200*b* can be in the form of protrusions extending from the web 113 of car mover track 85 that engages complementary impressions (or slots) in the first tire 135*a*. As illustrated in FIG. 5 the engagement features 200*a*, 200*b* may also be in the form of slots (or impressions, or holes) in the web 113 of the car mover track 85 that engage protrusions on the first tire 135*a*.

Figure 6A:
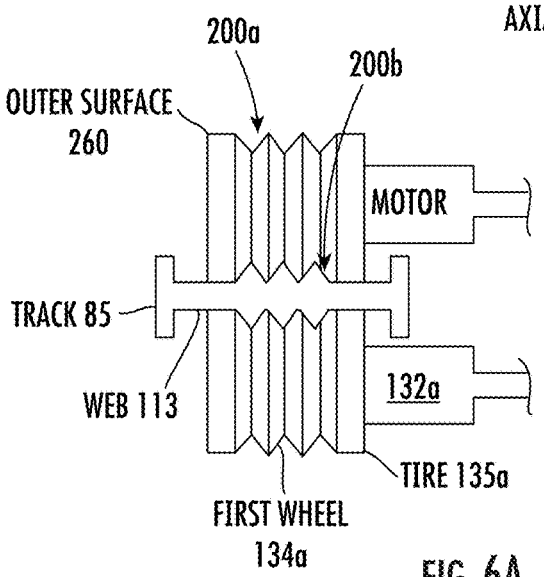
FIG. 6A shows portions of a car mover, where tires and a web of the car mover track have engagement features in the form of complimentary wedge shaped protrusions in the web and impressions in the tires, to provide enhanced traction.

FIG. 6A illustrates another embodiment of a non-flat running surface. In this case, the engagement features 200*a*, 200*b* include multiple V-shaped contours on the first tire 135*a* resulting in a plurality of raised tire grooves (e.g., forming wedges, ridges or a triangular waveform profile), that engage complimentary grooves on the web 113 of the car mover track 85. The embodiment of FIG. 6A provides greater contact area between first tire 135*a* and the car mover track 85, which results in a greater traction, and reduced coefficient of friction requirement.

Figure 6B:
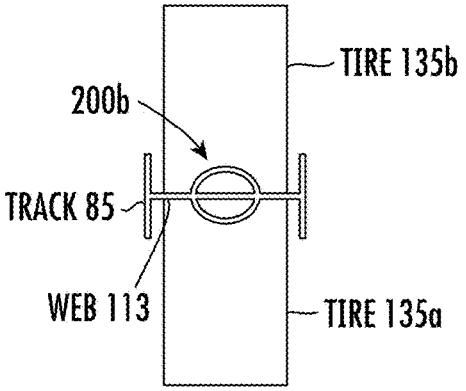
FIG. 6B shows tires and a web of the car mover track, where the web has engagement features in the form of semi-circular shaped protrusions on both sides of the web to provide enhanced traction.
Figure 6C:
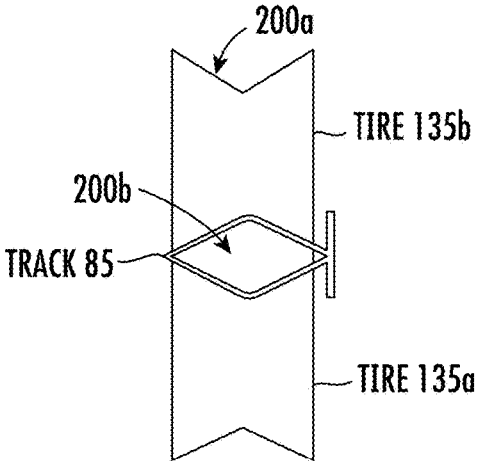
FIG. 6C shows tires and the car mover track having engagement features in the form of a wedge or diamond shaped track and complementary impressions in the tires, to provide enhanced traction.
Figure 6D:
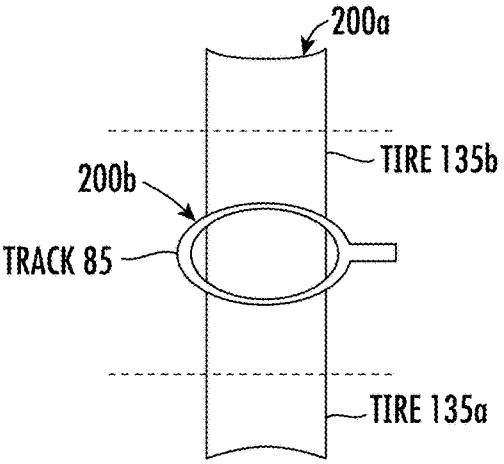
FIG. 6D shows tires and the car mover track having engagement features in the form of a track with a circular section and complementary impressions in the tires, to provide enhanced traction.
Figure 6E:
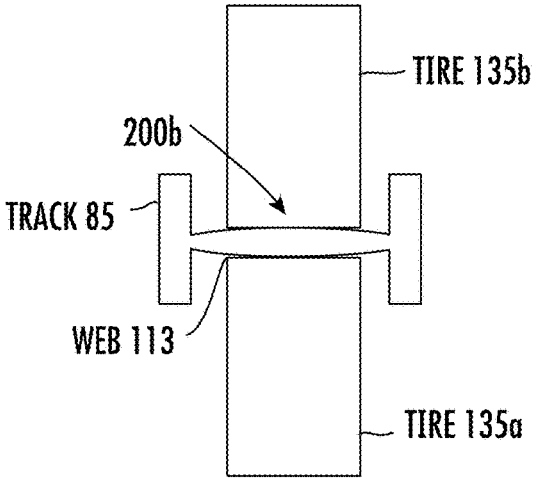
FIG. 6E shows tires and a web of the car mover track, where the web has engagement features in the form of a convex cross section, to provide enhanced traction.
Figure 6F:
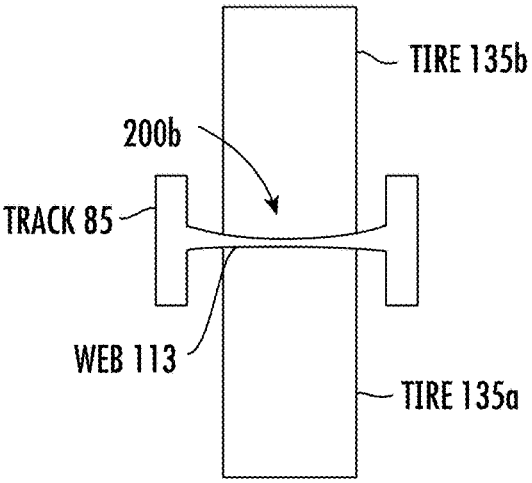
FIG. 6F shows tires and a web of the car mover track, where the web has engagement features in the form of a concave cross section, to provide enhanced traction.
Figure 6G:
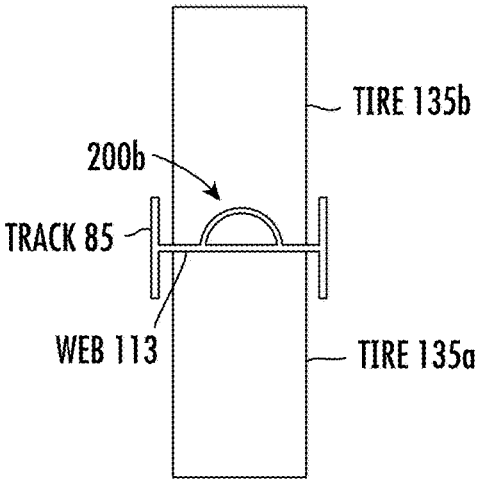
FIG. 6G shows tires and a web of the car mover track, where the has engagement features in the form of a semi-circular shaped protrusion on one side of the web, to enhance guidance.

FIG. 6B shows tires 135*a*, 135*b* and a web 113 of the car mover track 85. The web has engagement features 200*b* in the form of semi-circular shaped protrusions, forming semi-circular profile, on both sides of the web 113 to provide enhanced traction. FIG. 6C shows tires 135*a*, 135*b* and the car mover track 85 having engagement features in the form of a wedge or diamond shaped track features 200*b*, forming a wedge or diamond shaped profile, and complementary impressions forming engagement features 200*a* in the tires 135*a*, 135*b*, to provide enhanced traction. FIG. 6D shows tires 135*a*, 135*b* and the car mover track 85 having engagement features in the form of a track with features 200*b* defined by a circular section, forming a circular profile, and complementary impressions forming engagement features 200*a* on the tires 135*a*, 135*b*, to provide enhanced traction. FIG. 6E shows tires 135*a*, 135*b* and a web 113 of the car mover track 85. The web 113 has engagement features 200*b* in the form of a convex cross section, forming a convex profile, to provide enhanced traction. FIG. 6F shows tires 135*a*, 135*b* and a web 113 of the car mover track 85. The web 113 has engagement features 200*b* in the form of a concave cross section, forming a concave profile, to provide enhanced traction. FIG. 6G shows tires 135*a*, 135*b* and a web 113 of the car mover track 85. The web 113 has engagement features 200*b* in the form of a semi-circular shaped protrusion, forming a semi-circular profile, on one side of the web 113, to enhance guidance. The semi-circular profile of FIG. 6G is merely exemplary so that another other geometric feature 200*b* will provide the same benefit of enhanced guidance.

Thus, the disclosed embodiments in FIGS. 4-6 provide non-flat and/or non-solid beam surface which allows mechanical engagement rather than pure traction between the first tire 135*a* and the car mover track 85. As can be appreciated, the surface contours shown in FIGS. 4-6 extend circumferentially about the outer annular surface 260 of the first tire 135*a*. The engagement features 200*a* in FIG. 4 runs along the axial center 270 of the first tire 135*a*, though the engagement features 200*a* in FIG. 5 is offset from the axial center 270.

The embodiments shown in FIGS. 4-6 provide a benefit of a reduced normal force requirement and traction requirement between the first tire 135*a* and the car mover track 85, which may help prolong tire life and enhance system operation. The engagement features 200*a*, 200*b* also provide enhanced tracking/steering of the car mover 80*a* while in motion.

Figure 7:
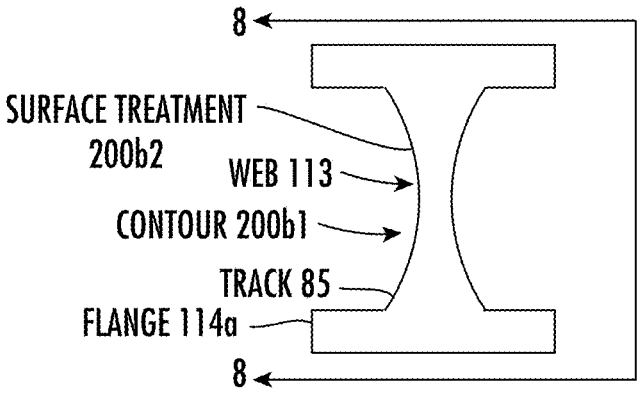
FIG. 7 shows the car mover track provided with engagement features in the form of a surface treatment and/or finishing to increase friction, and wherein the car mover track is formed with a concave shape and sections of the car mover track include tongue and grove alignment features.
Figure 8:
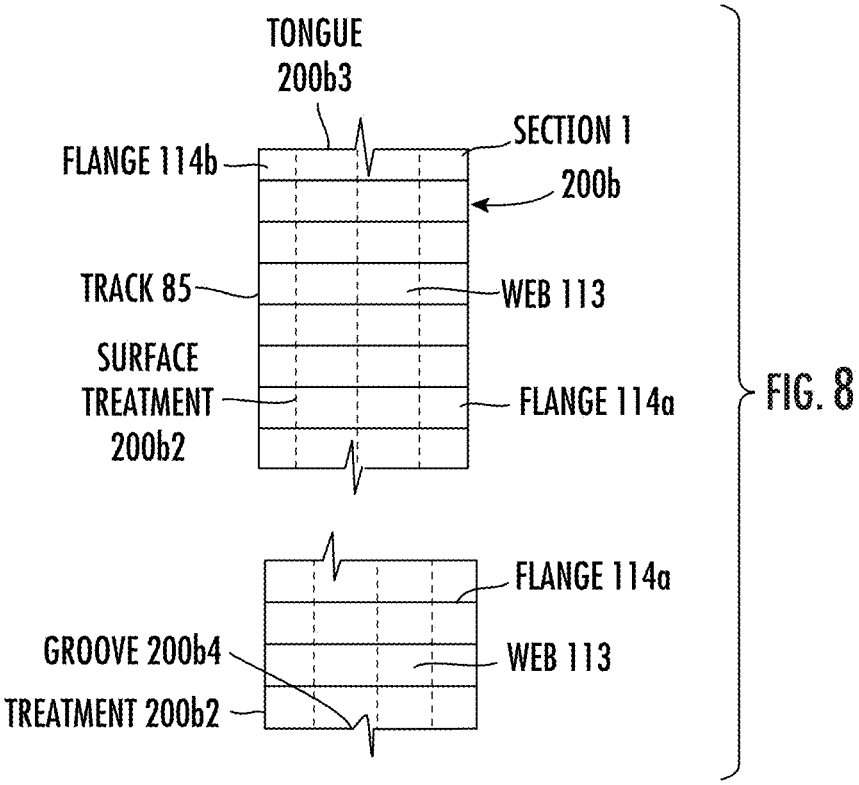
FIG. 8 shows the car mover track of FIG. 7 along section lines 8-8.

Turning to FIGS. 7-8, in a hub-wheel-motor based elevator system 10 as disclosed herein, the car mover 80*a* may rely on the web 113 of the car mover track 85 for traction. The web 113 should provide a sufficient coefficient of friction and ensure the tires 135 of the car mover 80*a* remains centered on the web 113. For this embodiment, as with the other embodiments here, reference shall be to the first tire 135*a* and the first wheel 134*a* as the tires 135 and wheels 134, and engagement with the car mover track 85, are substantially the same.

As shown in FIGS. 7-8, the track engagement features 200*b*, provided on the car mover track 85 (illustrated as an I-beam), includes a rounded (concave profile) shape (or surface contour) 200*b*1 for the web 113 (both sides). The concave shape of the web 113 increase the contact area with the first tire 135*a*, thus increasing the coefficient of friction, and also to ensure self-tracking of the first tire 135*a*.

In addition, the track engagement features 200*b* include a friction enhanced surface treatment (or surface coating) 200*b*2 applied to the car mover track 85. E.g., an asphalt coating or similar coating may be applied that provides the same or similar friction qualities. Some embodiments provide an anti-corrosion coating that results in a greater coefficient of friction. The disclosed embodiments also provide for varying the surface finish of the web 113 to provide an increase surface friction.

The car mover track 85 may include, as track engagement features 200*b*, complimentary alignment features 200*b*3, 200*b*4, respectively illustrated as tongue and groove connector features, formed in the web 113, e.g., midway between end flanges 114*a*, 114*b*. The alignment features 200*b*3, 200*b*4 may assure proper alignment between sections of the car mover track 85 (only one section is shown). The alignment features 200*b*3, 200*b*4 may enable a quick install as well.

The disclosed embodiments of FIGS. 7-8 provide greater traction characteristics between the car mover 80*a* and the car mover track 85. This may keep the car mover 80*a* centered on the web 113 as well as help manage noise, provide for a relatively quick install process, and provide for a more accurate alignment.

Figure 9:
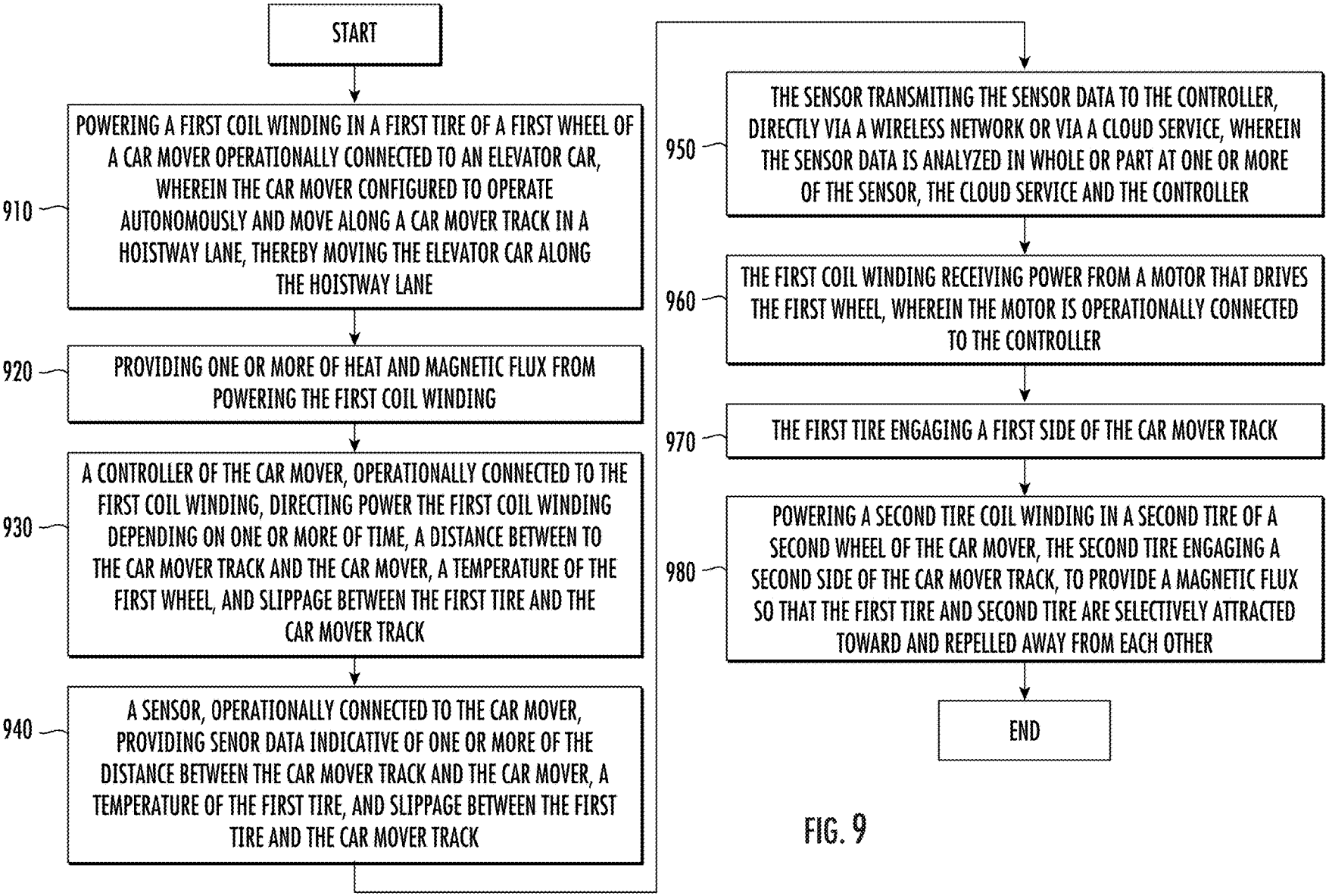
FIG. 9 shows a method of operating a ropeless elevator system according to an embodiment.

Turning to FIG. 9, a flowchart shows a method of operating a ropeless elevator system 10. As shown in block 910 the method includes powering a first coil winding 210*a* in a first tire 135*a* of a car mover 80*a*, operationally connected to an elevator car 50*a*. As indicated, the car mover 80*a* is configured to operate autonomously and move along a car mover track 85 in a hoistway lane 60, thereby moving the elevator car 50*a* along the hoistway lane 60.

As shown in block 920, the method includes providing one or more of heat and magnetic flux from powering the first coil winding 210*a*.

As shown in block 930, the method includes a controller 115 of the car mover 80*a*, operationally connected to the first coil winding 210*a*, directing power the first coil winding 210*a* depending on one or more of time, a distance between to the car mover track and the car mover, a temperature of the first tire 135*a*, and slippage between the first tire 135*a* and the car mover track 85.

As shown in block 940, the method includes a sensor 220, operationally connected to the car mover 80*a*, providing sensor data indicative of one or more of the distance between the car mover track 85 and the car mover 80*a*, a temperature of the first tire 135*a*, and slippage between the first tire 135*a* and the car mover track 85.

As shown in block 950, the method includes the sensor 220 transmitting the sensor data to the controller 115, directly, via a wireless network 230 or via a cloud service 240. The sensor data is analyzed in whole or part at one or more of the sensor 220, the cloud service 240 and the controller 115.

As shown in block 960, the method includes the first coil winding receiving power from a motor 132*a* that drives the first wheel 134*a*. The motor 132*a* is operationally connected to the controller 115.

As shown in block 970, the method includes the first tire 135*a* engaging a first side 85*a* of the car mover track. As shown in block 980, the method includes powering a second tire coil winding 210*c* in a second tire 135*b* of a second wheel 134*b* of the car mover 80*a*, the second tire 135*b* engaging a second side 85*b* of the car mover track 85, to provide a magnetic flux so that the first tire 135*a* and second tire 135*b* are selectively attracted toward and repelled away from each other.

As described above, embodiments can be in the form of processor-implemented processes and devices for practicing those processes, such as processor. Embodiments can also be in the form of computer program code (e.g., computer program product) containing instructions embodied in tangible media (e.g., non-transitory computer readable medium), such as floppy diskettes, CD ROMs, hard drives, or any other non-transitory computer readable medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an device for practicing the exemplary embodiments. When implemented on a general-purpose microprocessor, the computer program code segments configure the microprocessor to create specific logic circuits.

The terminology used herein is for the purpose of describing particular embodiments only and is not intended to be limiting of the present disclosure. The term "about" is intended to include the degree of error associated with measurement of the particular quantity and/or manufacturing tolerances based upon the equipment available at the time of filing the application. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A ropeless elevator system comprising:

a car mover operationally connected to an elevator car, the car mover configured to move along a car mover track in a hoistway lane, thereby moving the elevator car along the hoistway lane, wherein the car mover includes a first tire of a first wheel that is configured to engage the car mover track when the car mover moves along the car mover track, wherein one or more of the first tire and the car mover track includes an engagement feature for increasing traction between the first tire and the car mover track, wherein:

the first tire includes the engagement feature, wherein the engagement feature includes a first coil winding configured for being powered to provide one or more of heat and magnetic flux;

the first tire engages a first side of the car mover track; and the car mover includes a second tire of a second wheel that engages a second side of the car mover track, wherein the second tire includes a second tire coil winding configured for being powered to provide magnetic flux so that the first tire and the second tire are either attracted toward or repelled away from each other.

2. The system of claim 1, wherein:

the first coil winding is configured for being powered to provide heat and a second coil winding configured for being powered to provide magnetic flux.

3. The system of claim 1, wherein:

a controller of the car mover is operationally connected to the first coil winding and configured to direct power to the first coil winding depending on one or more of time, a distance between to the car mover track and the car mover, a temperature of the first tire, and slippage between the first tire and the car mover track.

4. The system of claim 3, wherein:

a sensor is operationally connected to the car mover and configured to provide sensor data indicative of one or more of the distance between the car mover track and the car mover, the temperature of the first tire, and slippage between the first tire and the car mover track.

5. The system of claim 4, wherein:

the sensor transmits the sensor data to the controller directly, via a wireless network or via a cloud service, and wherein the sensor data is analyzed in whole or part at one or more of the sensor, the cloud service and the controller.

6. The system of claim 3, wherein:

the first coil winding receives power from a motor that drives the first wheel, wherein the motor is operationally connected to the controller.

7. A ropeless elevator system comprising:

a car mover operationally connected to an elevator car, the car mover configured to move along a car mover track in a hoistway lane, thereby moving the elevator car along the hoistway lane, wherein the car mover includes a first tire of a first wheel that is configured to engage the car mover track when the car mover moves along the car mover track, wherein one or more of the first tire and the car mover track includes an engagement feature for increasing traction between the first tire and the car mover track, wherein:

the car mover track includes a track engagement feature that is configured to enhance one or more of traction and guidance when engaged by the first tire; and the track engagement feature is one or more of: a track cross section of the car mover track that forms a diamond profile or a circular profile; and a track web cross section of the car mover track that forms a convex profile, a concave profile, or a semi-circular profile on one side or both sides of the of the car mover track.

8. A ropeless elevator system comprising:

a car mover operationally connected to an elevator car, the car mover configured to move along a car mover track in a hoistway lane, thereby moving the elevator car along the hoistway lane, wherein the car mover includes a first tire of a first wheel that is configured to engage the car mover track when the car mover moves along the car mover track, wherein one or more of the first tire and the car mover track includes an engagement feature for increasing traction between the first tire and the car mover track, wherein:

the first tire includes a tire engagement feature and the car mover track includes a track engagement feature, wherein the tire engagement feature and the track engagement feature are located and shaped to complement each other and engage each other when the car mover moves along the car mover track;

the tire engagement feature is one of protrusions and impressions formed circumferentially along an outer annular surface of the first tire;

the track engagement feature is another of protrusions and impressions along the car mover track; and either:

the tire engagement feature is axially centered or offset from an axial center of the first tire; or the tire engagement feature and the track engagement feature form a triangular waveform profile.

9. A method of operating a ropeless elevator system comprising:

powering a first coil winding in a first tire of a first wheel of a car mover operationally connected to an elevator car, wherein the car mover configured to move along a car mover track in a hoistway lane, thereby moving the elevator car along the hoistway lane; and providing one or more of heat and magnetic flux from powering the first coil winding the first tire engaging a first side of the car mover track; and powering a second tire coil winding in a second tire of a second wheel of the car mover, the second tire engaging a second side of the car mover track, to provide magnetic flux so that the first tire and the second tire are selectively attracted toward and repelled away from each other.

10. The method of claim 9, comprising:

a controller of the car mover, operationally connected to the first coil winding, directing power the first coil winding depending on one or more of time, a distance between to the car mover track and the car mover, a temperature of the first tire, and slippage between the first tire and the car mover track.

11. The method of claim 10, comprising:

a sensor, operationally connected to the car mover, providing sensor data indicative of one or more of the distance between the car mover track and the car mover, a temperature of the first tire, and slippage between the first tire and the car mover track.

12. The method of claim 11, comprising:

the sensor transmitting the sensor data to the controller, directly, via a wireless network or via a cloud service, wherein the sensor data is analyzed in whole or part at one or more of the sensor, the cloud service and the controller.

13. The method of claim 10, comprising:

the first coil winding receiving power from a motor that drives the first wheel, wherein the motor is operationally connected to the controller.

* * * * *